US006311683B1

(12) United States Patent
Lee

(10) Patent No.: US 6,311,683 B1
(45) Date of Patent: Nov. 6, 2001

(54) DEVICE FOR ASSEMBLING AND DISASSEMBLING GAS RIFLE AND GAS TANK TO AND FROM EACH OTHER

(76) Inventor: Kwang-soo Lee, 1304, Greentown 1317 Dong, 188th Beonji, Cuung-dong, Wonmi-gu, Puchon-si, Kyeongki-do (KR)

( * ) Notice: Subject to any disclaimer, the term of this patent is extended or adjusted under 35 U.S.C. 154(b) by 0 days.

(21) Appl. No.: 09/525,362

(22) Filed: Mar. 15, 2000

(30) Foreign Application Priority Data

Mar. 17, 1999 (KR) ..... 99-9059

(51) Int. Cl.[7] ..... F41B 11/00
(52) U.S. Cl. ..... 124/71; 124/74
(58) Field of Search ..... 285/316; 124/71, 124/74

(56) References Cited

U.S. PATENT DOCUMENTS

| | | | | |
|---|---|---|---|---|
| 3,761,117 | * | 9/1973 | Shendure | 285/277 |
| 4,060,219 | * | 11/1977 | Crawford | 251/149.6 |
| 4,664,420 | * | 5/1987 | Demeri | 285/86 |
| 4,819,609 | * | 4/1989 | Tippmann | 124/72 |
| 5,755,213 | * | 5/1998 | Gardner, Jr. et al. | 124/73 |
| 5,950,611 | * | 9/1999 | Lopez et al. | 124/72 |

* cited by examiner

*Primary Examiner*—Peter M. Poon
*Assistant Examiner*—Kevin Jakel
(74) *Attorney, Agent, or Firm*—Cheryl H. Agris

(57) ABSTRACT

Disclosed is a device for assembling and disassembling a gas rifle and a gas tank to and from each other, respectively. The device comprises a gas tank having a rear cap which has an adjusting valve for adjusting a gas discharging amount and a one-touch type connection pipe which has an inclined surface at a distal end thereof and a circumferential bearing groove; a gas discharging pipe; a fixed pipe having a plurality of holes and a plurality of balls which are fitted into the plurality of holes, respectively, the plurality of balls being able to be moved between a retracted position and a projected position, being engaged into the circumferential bearing groove at the retracted position and being disengaged from the circumferential bearing groove at the projected position; a control pipe for controlling the movement of the balls between the retracted position and the projected position, thereby to allow the gas tank to be assembled to the gas discharging pipe when the balls are in the retracted position and disassembled from the gas discharging pipe when the balls are in the projected position; and a contact valve being brought into close contact with the inclined surface when the gas tank is assembled to the gas discharging pipe and being detached from the inclined surface when the gas tank is disassembled from the gas discharging pipe.

2 Claims, 4 Drawing Sheets

DEVICE FOR ASSEMBLING AND DISASSEMBLING GAS RIFLE AND GAS TANK TO AND FROM EACH OTHER

BACKGROUND OF THE INVENTION

1. Field of the Invention

The present invention relates to a gas rifle (air rifle) which is generally used for hunting, and more particularly, the present invention relates to a device for assembling and disassembling a gas rifle and a gas tank to and from each other, which enables the gas tank to be easily disassembled from the gas rifle when storing the gas rifle in a place and taking the gas tank for gas recharging, thereby improving a user's convenience and increasing a safety factor upon handling the gas rifle and the gas tank.

2. Description of the Related Art

Generally, a gas rifle refers to a gun which propels a projectile using compressed gas which is charged into a gas tank. A projectile which is used in a gas rifle, is divided into a single bullet type projectile and shrapnel type projectiles.

A single bullet type projectile has a diameter of about 4.5 mm–5.5 mm and is propelled singularly. Shrapnel type projectiles are a plurality of small-sized pellets which are contained in a cartridge. The plurality of small-sized pellets are simultaneously and distributedly propelled as one end of the cartridge is opened.

Regardless of a type of a projectile, a projectile is propelled from the same rifle. In other words, projectiles are divided merely by a use thereof. The projectiles are propelled by discharging pressure of a quantity of compressed gas which is momentarily discharged from a gas tank upon actuation of a trigger mechanism of a gas rifle.

However, a conventional gas tank which is used in a gas rifle, suffers from defects in that, since the conventional gas tank is constructed in a manner such that it cannot be easily disassembled from the gas rifle except when the gas rifle is to be carried by parts or is to be repaired, inconvenience is caused due to its weight and/or its outer appearance. Furthermore, when compressed gas is ultimately depleted, the gas rifle must be moved to a gas charging station in a state wherein the gas tank is attached thereto. Therefore, when moving the gas rifle, a sensation of fear can be roused in others, and an accidental firing can occur.

SUMMARY OF THE INVENTION

Accordingly, the present invention has been made in an effort to solve the problems occurring in the related art, and an object of the present invention is to provide a device for assembling and disassembling a gas rifle and a gas tank to and from each other, which enables the gas tank to be easily disassembled from the gas rifle when storing the gas rifle in a place and taking the gas tank for gas recharging, thereby improving a user's convenience, contributing to the extension of a lifetime of the gas rifle, not rousing in others a sensation of fear, and preventing accidental firing from occurring, when storing and moving the gas rifle.

In order to achieve the above object, according to the present invention, there is provided a device for assembling and disassembling a gas rifle and a gas tank to and from each other, respectively, the device comprising: a gas tank having a rear cap, the rear cap being formed with a fixing pin hole and having a one-touch type connection pipe, the one-touch type connection pipe having an inclined surface at a distal end thereof and a circumferential bearing groove, the rear cap further having an adjusting valve for adjusting a gas discharging amount of the gas tank; a gas discharging pipe having a fixing pin which is inserted into the fixing pin hole of the rear cap to prevent the gas tank from fluctuating; a fixed pipe secured to the gas discharging pipe and having a plurality of holes which are formed in a manner such that they are spaced apart one from another in a circumferential direction, the fixed pipe further having a plurality of balls which are fitted into the plurality of holes, respectively, the plurality of balls constituting a sliding ball bearing and being able to be moved between a retracted position and a projected position, the plurality of balls being engaged into the circumferential bearing groove of the one-touch type connection pipe at the retracted position and being disengaged from the circumferential bearing groove of the one-touch type connection pipe at the projected position; a control pipe for controlling the movement of the plurality of balls between the retracted position and the projected position, thereby to allow the gas tank to be assembled to the gas discharging pipe when the plurality of balls are in the retracted position and to be disassembled from the gas discharging pipe when the plurality of balls are in the projected position; a contact valve being brought into close contact with the inclined surface of the one-touch type connection pipe when the gas tank is assembled to the gas discharging pipe and being detached from the inclined surface of the one-touch type connection pipe when the gas tank is disassembled from the gas discharging pipe; a first spring for biasing forward the control pipe; and a second spring for biasing forward the fixed pipe.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
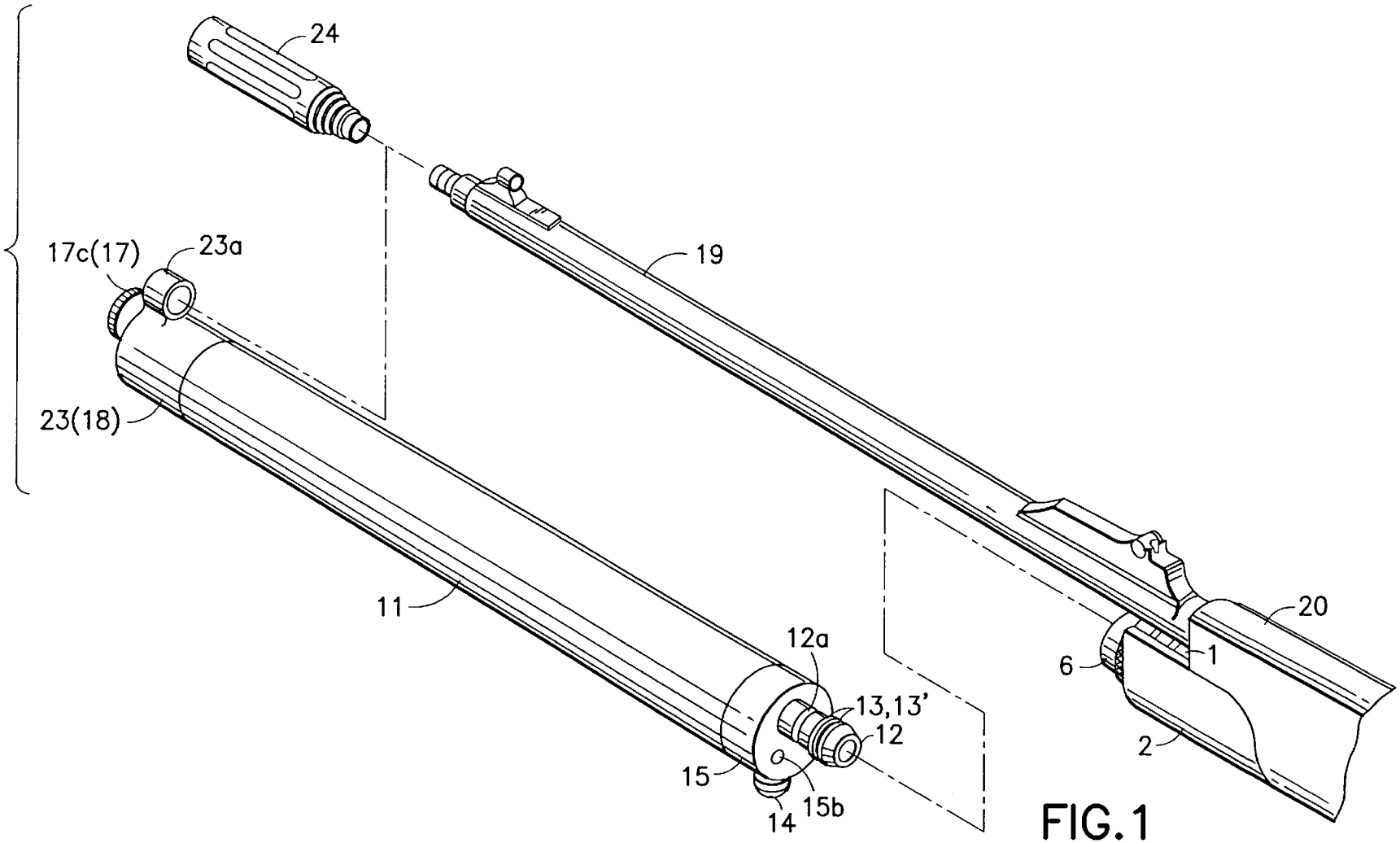
FIG. 1 is an exploded perspective view illustrating a gas rifle and a gas tank.
Figure 2:
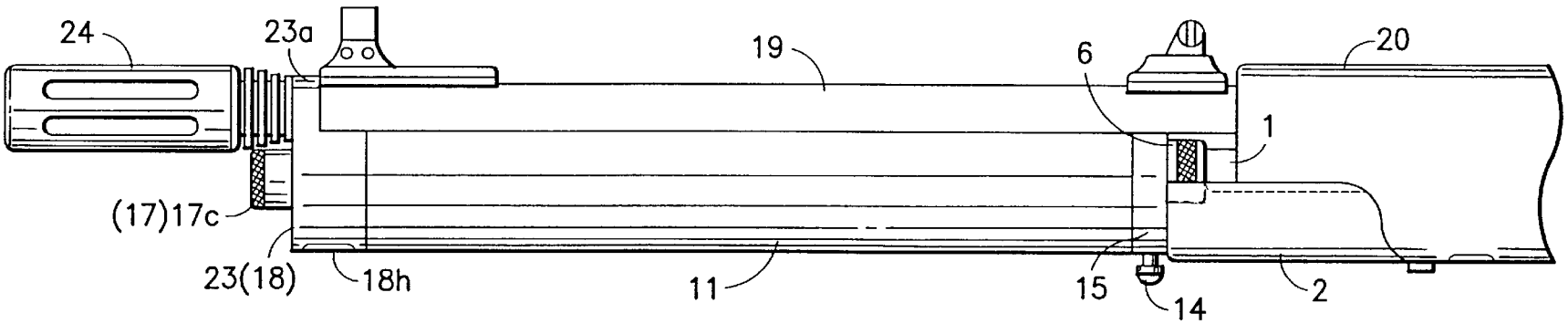
FIG. 2 is a front view illustrating a state wherein the gas rifle and the gas tank of FIG. 1 are assembled to each other.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to the attached drawings, the device for assembling and disassembling a gas rifle and a gas tank to and from each other includes a gas discharging pipe 1. The gas discharging pipe 1 is mounted to a lower surface of a rifle cover 20. The gas discharging pipe 1 has a fixing pin 4 and an under-cover bolt locking piece 3. An under-cover bolt (not shown) for securing an under-cover 2 to the gas discharging pipe 1 is screwed to the under-cover bolt locking piece 3.

Figure 4:
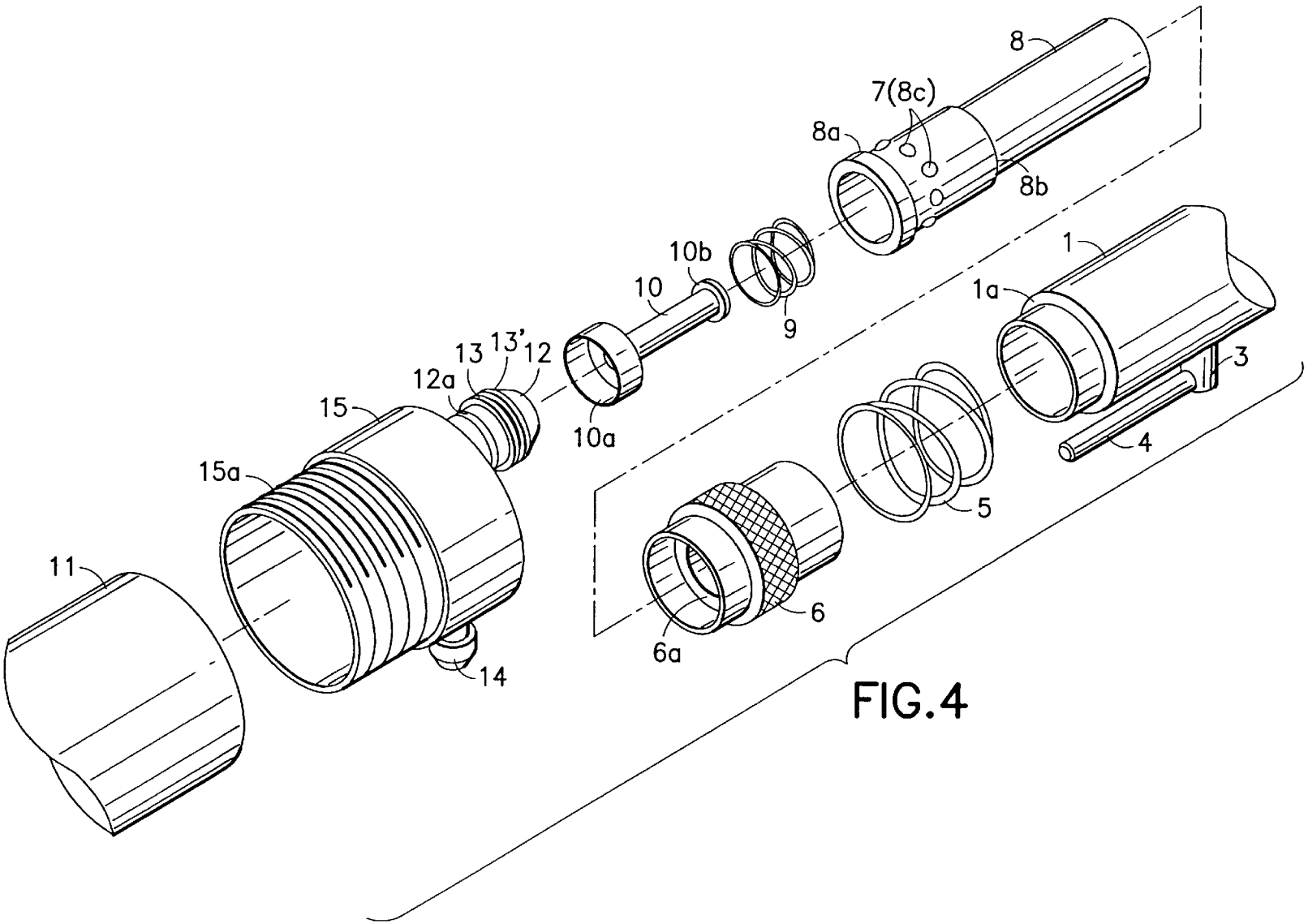
FIG. 4 is an exploded perspective view illustrating main components which constitute the device for assembling and disassembling the gas rifle and the gas tank to and from each other, according to the present invention.

As shown in FIG. 4, at a front end of the gas discharging pipe 1, there are arranged a first spring 5, a control pipe 6, a fixed pipe 8 which includes a sliding ball bearing 7, a second spring 9, and a contact valve 10. The first spring 5 functions to bias forward the control pipe 6. The fixed pipe 8 has a plurality of holes 8*c*. The plurality of holes 8*c* are formed adjacent to a front end of the fixed pipe 8 in a manner such that they are spaced apart one from another along a circumferential direction. The sliding ball bearing 7 has a plurality of balls which are fitted into the plurality of holes 8*c*, respectively. The plurality of balls can be moved between a retracted position and a projected position. In the retracted position, the plurality of balls are moved inward of the plurality of holes 8*c*, respectively. In the projected position, the plurality of balls are projected outward of the plurality of holes 8*c*, respectively. The control pipe 6 controls the movement of the plurality of balls which constitute the sliding ball bearing 7, between the retracted position and the projected position. When the plurality of balls are in the retracted position, a gas tank 11 is assembled to the gas discharging pipe 1, that is, to the gas rifle. When the plurality of balls are in the projected position, the gas tank 11 is disassembled from the gas discharging pipe 1, that is, from the gas rifle. Therefore, the sliding ball bearing 7 performs a task of leading assembling and disassembling operations for the gas tank 11. A one-touch type connection pipe 12 is provided at a rear end of the gas tank 11. The contact valve 10 is brought into close contact with the one-touch type connection pipe 12 when the gas tank 11 is assembled to the gas discharging pipe 1 and is detached from the one-touch type connection pipe 12 when the gas tank 11 is disassembled from the gas discharging pipe 1. The second spring 9 functions to bias forward the contact valve 10.

The gas tank 11 is assembled and disassembled at a front end thereof to and from a front end of a barrel 19 of the gas rifle. Also, the gas tank 11 is assembled and disassembled at the rear end thereof to and from the gas discharging pipe 1. The gas tank 11 is opened at both ends thereof. A front cap 18 is coupled to the front end of the gas tank 11, and a rear cap 15 is coupled to the rear end of the gas tank 11. The one-touch type connection pipe 12 is provided to the rear cap 15. An Andrews bearing groove 12*a* is formed on the one-touch type connection pipe 12 so that it extends in a circumferential direction. The rear cap 15 includes an adjusting valve 14 for adjusting a gas discharging amount. The front cap 18 includes a scale gauge 16 and a gas injecting valve 17. The scale gauge 16 enables a user to confirm an amount of gas which exists in the gas tank 11. Gas can be supplied from a gas supplying source into the gas tank 11 through the gas injection valve 17, irrespective of the fact that the gas tank 11 is assembled to or disassembled from the gas rifle.

Figure 3:
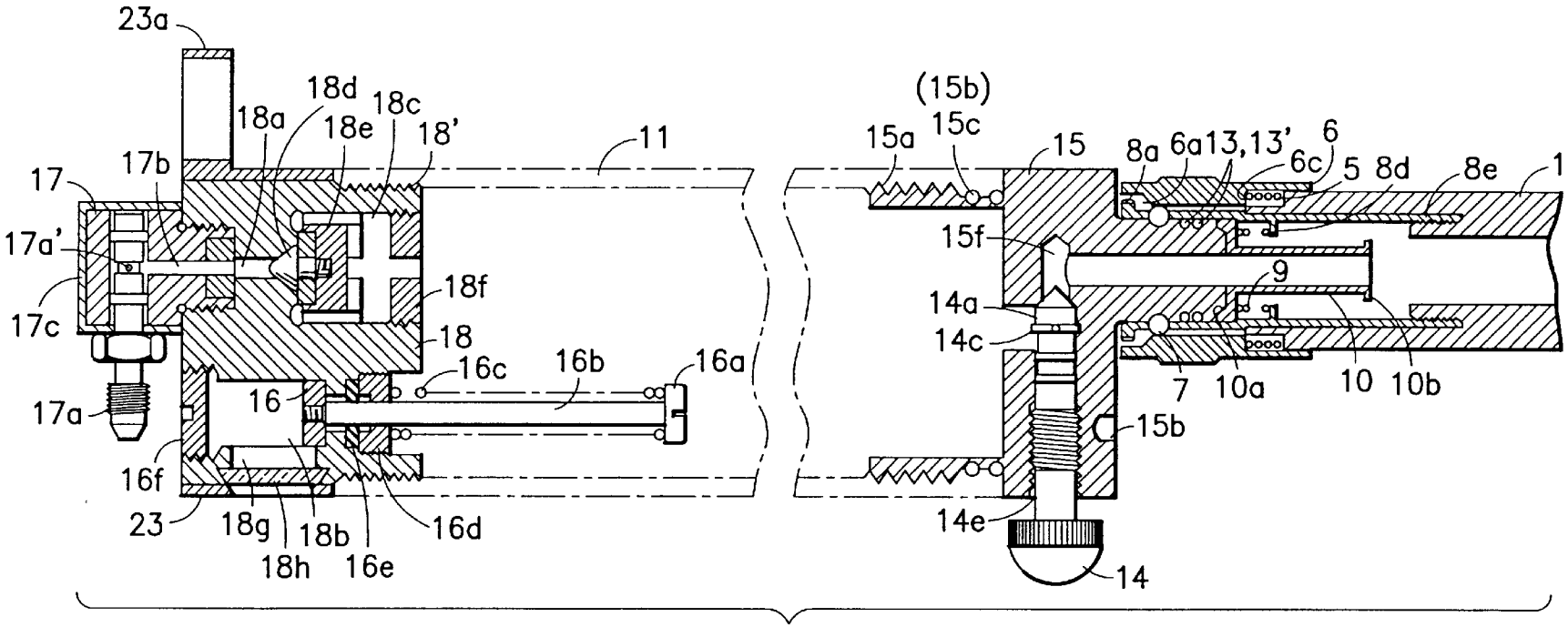
FIG. 3 is a cross-sectional view illustrating a device for assembling and disassembling the gas rifle and the gas tank to and from each other, in accordance with an embodiment of the present invention.

Hereinafter, a detailed construction of the device for assembling and disassembling the gas rifle and the gas tank to and from each other will be described with reference to FIGS. 3 and 4.

The gas discharging pipe 1 is formed adjacent to the front end thereof with an externally-threaded portion. The fixed pipe 8 is formed at a rear end thereof with an internally-threaded portion 8*e* which is threadedly coupled to the externally-threaded portion of the gas discharging pipe 1. Also, as described above, the under-cover bolt locking piece 3 having the fixing pin 4 is secured to the gas discharging pipe 1. At the front end of the gas discharging pipe 1, there are arranged the first and second springs 5 and 9, the control pipe 6, the fixed pipe 8 having the sliding ball bearing 7, and the contact valve 10, through which the gas tank 11 can be assembled to and disassembled from the gas discharging pipe 1.

Between the first and second springs 5 and 9, the first spring 5 has a diameter which is larger than that of the second spring 9. The first spring 5 having a larger diameter is supported by the gas discharging pipe 1 and functions to bias forward the control pipe 6. The second spring 9 having a smaller diameter is inserted into the fixed pipe 8 and functions to bias forward the contact valve 10.

The control pipe 6 serves as a structure which is pulled rearward by the hand when the gas tank 11 is disassembled from the gas discharging pipe 1, thereby to allow the plurality of balls constituting the sliding ball bearing 7 to be moved from the retracted position to the projected position. At a middle part of the control pipe 6, a circumferential outer surface of the control pipe 6 is formed with a knurled portion which prevents the hand from slipping on the control pipe 6 when pulling rearward the control pipe 6. The control pipe 6 defines a space into which the sliding ball bearing 7 is accommodated. Adjacent to a front end of the control pipe 6, a ball squeezing surface 6*a* is formed on a circumferential inner surface of the control pipe 6. Further, adjacent to a rear end of the control pipe 6, a spring-supporting stepped portion 6*c* is formed on the circumferential inner surface of the control pipe 6. The spring-supporting stepped portion 6*c* supports the first spring 5.

As described above, the sliding ball bearing 7 has the plurality of balls which are fitted into the plurality of holes 8*c*, respectively, which in turn are defined in the fixed pipe 8. At this time, the plurality of balls are not fully, but by a predetermined depth, fitted into the plurality of holes 8*c*, respectively. In this respect, it is to be readily understood that, unless the plurality of balls are squeezed by the control pipe 6 into the plurality of holes 8*c*, they are willing to move to the projected position.

The fixed pipe 8 serves as a structure which holds the above-mentioned components, that is, the first and second springs 5 and 9, the control pipe 6 and the fixed pipe 8 having the sliding ball bearing 7, to the gas discharging pipe 1. As described above, the fixed pipe 8 is formed at the rear end thereof with the internally-threaded portion 8*e* which is threadedly coupled to the externally-threaded portion of the gas discharging pipe 1. A circumferential outer surface of the fixed pipe 8 has at the front end thereof a circumferential projection 8*a* and at a middle part thereof an outward-protruding stepped portion 8*b*. An inward protrusion 8*d* is formed on a circumferential inner surface of the fixed pipe 8 adjacent to the middle part. Each of the plurality of holes 8*c* which are defined in the fixed pipe 8, has a radial inner end and a radial outer end. The radial inner end of each hole 8*c* has a diameter which is smaller than that of the radial outer end. As described above, the plurality of holes 8*c* are formed in a manner such that they are spaced apart one from another along the circumferential direction.

The contact valve 10 serves as a structure which is brought into close contact with an inclined surface which is formed at a rear end of the one-touch type connection pipe 12, when the gas tank 11 is assembled to the gas discharging pipe 1. An outward protrusion 10*b* is formed at a rear end of the contact valve 10. An inclined contact surface 10*a* is formed at a front end of the contact valve 10 in a manner such that it is diverged toward the one-touch type connection pipe 12 while having an increased outer diameter when compared to that of the outward protrusion 10*b*.

The above-mentioned components are sequentially assembled. First, the second spring 9 is inserted into the fixed pipe 8, and then, the contact valve 10 is pushed into the fixed pipe 8 while compressing the second spring 9.

When the contact valve 10 is pushed into the fixed pipe 8 following the second spring 9, the second spring 9 is compressed and at the same time, functions to bias forward the contact valve 10 toward the one-touch type connection pipe 12. The contact valve 10 which is pushed into the fixed pipe 10 in this way, is securely held in the fixed pipe 10 due to the fact that the outward protrusion 10*b* formed at the rear end thereof is seated onto the inward protrusion 8*d* formed on the circumferential inner surface of the fixed pipe 8 adjacent to the middle part of the fixed pipe 8.

In a state wherein the plurality of balls are fitted into the plurality of holes 8*c*, respectively, of the fixed pipe 8 into which the contact valve 10 is inserted, thereby to complete the sliding ball bearing 7, the control pipe 6 and the first spring 5 are fitted around the fixed pipe 8. In this state, the fixed pipe 8 is coupled to the gas discharging pipe 1 at its rear end. Namely, the internally-threaded portion 8*e* of the fixed pipe 8 is threadedly coupled to the externally-threaded portion of the gas discharging pipe 1. In this way, coupling of the above-mentioned components to the gas discharging pipe 1 is completed.

As described above, the rear cap 15 is threadedly coupled to the rear end of the gas tank 11. As can be readily seen from FIG. 3, at a front end of the rear cap 15, an externally-threaded portion 15*a* is formed on a circumferential outer surface of the rear cap 15. The externally-threaded portion 15*a* of the rear cap 15 is threadedly coupled to an internally-threaded portion which is formed at the rear end of the gas tank 11. Adjoining the externally-threaded portion 15*a* of the rear cap 15, at least one semi-circular O-ring groove 15*b* is formed on the rear cap 15 in a manner such that it extends in a circumferential direction. At least one O-ring 15*c* is engaged into the semi-circular O-ring groove 15*b*. A gas discharging hole 15*f* is defined in a vertical wall portion of the rear cap 15 and is communicated with the inside of the gas tank 11. The one-touch type connection pipe 12 is integrally and eccentrically provided at a rear end of the rear cap 15, and the gas discharging hole 15*f* extends through the one-touch type connection pipe 12.

At this time, the one-touch type connection pipe 12 is formed in a manner such that it has the inclined surface at its distal, that is, rear end. The one-touch type connection pipe 12 has the Andrews bearing groove 12*a* and a pair of O-ring grooves 12*b*, which are formed in a side by side relationship on a circumferential outer surface of the one-touch type connection pipe 12. A pair of O-rings 13 and 13' are engaged into the pair of O-ring grooves 12*b*, respectively. As described above, the gas discharging hole 15*f* which is formed in the rear cap 15, extends through the one-touch type connection pipe 12. The vertical wall portion of the rear cap 15 is formed adjacent to a lower end thereof with an internally-threaded portion 15*e* which is communicated with the gas discharging hole 15*f*. The adjusting valve 14 for adjusting a gas discharging amount is threadedly coupled to the internally-threaded portion 14*e* of the rear cap 15. Adjacent to a distal, that is, upper end of the adjusting valve 14, a packing member 14*a*, an O-ring 14*b* and a release preventing ring 14*c* are fitted around the adjusting valve 14.

The front cap 18 has an inner gas supplying hole 18*a* and a scale moving space 18*b* which are defined therein.

The inner gas supplying hole 18*a* is communicated with a valve sliding space 18*c* which is defined inward of the inner gas supplying hole 18*a*. The valve sliding space 18*c* has a volume which is larger than that of the inner gas supplying hole 18*a*. A sliding valve 18*e* which has a cone-shaped control valve portion 18*d*, is reciprocatingly received into the valve sliding space 18*c*. A cap bolt 18*f* is screwed to a rear end of the front cap 18 which defines the valve sliding space 18*c*. Gas can be supplied into the gas tank 11 through a gas flowing hole which is formed at a center portion of the cap bolt 18*f*.

The gas injecting valve 17 is threadedly coupled to a front end of the front cap 18. The front cap 18 is formed with a T-shaped outer gas supplying hole 17*b* which is communicated with the inner gas supplying hole 18*a*. The T-shaped outer gas supplying hole 17*b* is positioned opposite to the valve sliding space 18*c*. The gas injecting valve 17 includes a gas injecting nozzle 17*a* and a valve cover 17*c*. The scale gauge 16 is reciprocatingly disposed in the scale moving space 18*b*. A gauge shaft 16*b* having a shaft head portion 16*a* is secured to an inner surface of the scale gauge 16. Movement of the gauge shaft 16*b* relying upon a change in an amount of gas which exists in the gas tank 11, is guided by a shaft guide bolt 16*d* which is screwed to the front cap 18. Between the shaft guide bolt 16*d* and a projection which delimits an inner end of the scale moving space 18*b*, there is arranged an O-ring 16*e*. A compression spring 16*c* is wound around the gauge shaft 16*b*. An outer end of the scale moving space 18*b* is closed by a cap bolt 16*f* which is screwed to the front cap 18.

Moreover, a sight space 18*g* is defined below the scale moving space 18*b* in a manner such that it is communicated with the scale moving space 18*b*. A sight glass 18*h* is arranged in the sight space 18*g*. A cap cover 23 is threadedly coupled to a circumferential outer surface of the front end of the front cap 18. The cap cover 23 has a barrel end connection pipe 23*a* into which the barrel 19 of the gas rifle is inserted. The barrel end connection pipe 23*a* enables the gas tank 11 to be quickly and simply assembled to and disassembled from the barrel 19 of the gas rifle.

Hereinafter, operations of the device for assembling and disassembling the gas rifle and the gas tank to and from each other, will be described in detail.

When the gas tank 11 is disassembled from the gas rifle, a barrel decorating end piece 24 is removed from the barrel 19 of the gas rifle, by being rotated. Then, in a state wherein the gas tank 11 is grasped by one hand, the control pipe 6 is grasped by the other hand and pulled rearward toward a butt plate (not shown) of the gas rifle. By doing this, as the control pipe 6 is slidably moved toward the butt plate of the gas rifle, the ball squeezing surface 6*a* which is formed on the circumferential inner surface of the control pipe 6, is positioned just above the sliding ball bearing 7 of the fixed pipe 8.

When the gas tank 11 is assembled to the gas discharging pipe 1, the control pipe 6 is maintained in its original position where it is biased forward by the first spring 5. If the control pipe 6 is maintained in its original position, the plurality of balls constituting the sliding ball bearing 7 are squeezed into the plurality of holes 8*c*, respectively, which are defined in the fixed pipe 8, whereby the plurality of balls are maintained in the retracted position. The plurality of balls which are moved to the retracted position, are engaged into the Andrews bearing groove 12*a* which is formed in the one-touch type connection pipe 12. Accordingly, the plurality of balls are held engaged into the Andrews bearing groove 12*a*, whereby the gas tank 11 is maintained in a state wherein it is assembled to the gas discharging pipe 1.

However, by pulling rearward the control pipe 6 toward the butt plate of the gas rifle, the control pipe 6 is moved rearward by a preset distance. By the fact that the control pipe 6 is moved rearward, at the time when the ball squeezing surface 6*a* passes over the sliding ball bearing 7, the plurality of balls are moved to the projected position. Therefore, as the plurality of balls are disengaged from the Andrews bearing groove 12*a*, the gas tank 11 is disassembled from the gas discharging pipe 1.

On the contrary, when the gas tank 11 is assembled again to the gas discharging pipe 1, the above described operations are performed in a reverse order. That is to say, the barrel end connection pipe 23*a* of the gas tank 11 is fitted around the front end of the barrel 19. Then, in a state wherein the one-touch type connection pipe 12 is brought into close contact with the inclined contact surface 10*a* of the contact valve 10, the control pipe 6 which is pulled rearward upon disassembling the gas tank 11 from the gas discharging pipe 1, is released.

If the control pipe 6 is released, as the ball squeezing surface 6*a* passes again forward over the sliding ball bearing 7, the plurality of balls are squeezed by the circumferential inner surface of the control pipe 6, which has the narrowest diameter, whereby the plurality of balls are moved again to the retracted position.

Consequently, as the plurality of balls are moved again to the retracted position, the plurality of balls are engaged again into the Andrews bearing groove 12*a* of the one-touch type connection pipe 12. At this time, a front end of the fixing pin 4 is inserted into a fixing pin hole 15*b* which is formed in the rear cap 15, thereby preventing the gas tank 11 from fluctuating leftward and rightward. In the meanwhile, in a state wherein the gas tank 11 is fully filled with gas, the gas injecting nozzle 17*a* is pulled from the gas injecting valve 17 to be detached therefrom. Then, the valve cover 17*c* is rotated by over 90°, whereby a nozzle hole is closed. When it is required to recharge gas into the gas tank 11, the gas injecting nozzle 17*a* is fitted into the nozzle hole which is formed in the gas injecting valve 17. Recharging gas flows into the inner gas supplying hole 18*a* through a gas injection hole 17*a*' and the T-shaped outer gas supplying hole 17*b*. Then, the recharging gas is supplied into the gas tank 11 through the valve sliding space 18*c* while pushing rearward the sliding valve 18*e* having the cone-shaped control valve portion 18*d*. After the gas tank 11 is fully filled with gas, if the gas tank 11 is removed from a recharging gas tank, the sliding valve 18*e* is moved outward by inner gas pressure, and the cone-shaped control valve portion 18*d* closes the inner gas supplying hole 18*a*. At this time, as the compression spring 16*c* is compressed depending upon an amount of gas which exists in the gas tank 11, the gauge shaft 16*b* is slidably moved outward. Thus, the scale gauge 16 is also moved outward in the scale moving space 18*b*. A distance over which the scale gauge 16 is moved along the scale moving space 18*b*, can be confirmed from the outside through the sight glass 18*h*, whereby a gas charging amount can be easily read through the scale gauge 16.

As described above, the device for assembling and disassembling the gas rifle and the gas tank to and from each other, constructed as mentioned above, provides advantages in that, since it is possible to easily assemble and disassemble the gas tank to and from the gas rifle, a user's convenience is improved when storing the gas rifle in a place and taking the gas tank for gas charging. Specifically, because it is possible to separately purchase the gas tank and the gas rifle, by preparing a spare gas tank, hunting can be enjoyed in a convenient manner, due to the fact that it is not necessary to carry a weighty, bulky and expensive recharging gas tank.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A device for assembling and disassembling a gas rifle and a gas tank to and from each other, respectively, the device comprising:

a gas tank having a rear cap, the rear cap being formed with a fixing pin hole and having a one-touch type connection pipe, the one-touch type connection pipe having an inclined surface at a distal end thereof and a circumferential bearing groove, the rear cap further having an adjusting valve for adjusting a gas discharging amount of the gas tank;

a gas discharging pipe having a fixing pin which is inserted into the fixing pin hole of the rear cap to prevent the gas tank from fluctuating;

a fixed pipe secured to the gas discharging pipe and having a plurality of holes which are formed in a manner such that they are spaced apart one from another in a circumferential direction, the fixed pipe further having a plurality of balls which are fitted into the plurality of holes, respectively, the plurality of balls constituting a sliding ball bearing and being able to be moved between a retracted position and a projected position, the plurality of balls being engaged into the circumferential bearing groove of the one-touch type connection pipe at the retracted position and being disengaged from the circumferential bearing groove of the one-touch type connection pipe at the projected position;

a control pipe for controlling the movement of the plurality of balls between the retracted position and the projected position, thereby to allow the gas tank to be assembled to the gas discharging pipe when the plurality of balls are in the retracted position and to be disassembled from the gas discharging pipe when the plurality of balls are in the projected position;

a contact valve being brought into close contact with the inclined surface of the one-touch type connection pipe when the gas tank is assembled to the gas discharging pipe and being detached from the inclined surface of the one-touch type connection pipe when the gas tank is disassembled from the gas discharging pipe;

a first spring for biasing forward the control pipe; and a second spring for biasing forward the fixed pipe.

2. The device as claimed in claim 1, wherein the gas tank further has a front cap which includes a scale gauge, a gas injecting valve, a sliding valve and a cap cover, the scale gauge enabling a user to confirm an amount of gas which exists in the gas tank, the gas injecting valve allowing recharging gas to be injected toward the sliding valve, the sliding valve being biased by recharging gas pressure and thereby allowing the recharging gas to be supplied into the gas tank, the cap cover being threadedly coupled to a circumferential outer surface of the front end of the front cap.

* * * * *